US008298025B2

(12) United States Patent
Eichinger

(10) Patent No.: US 8,298,025 B2
(45) Date of Patent: Oct. 30, 2012

(54) COOLING SYSTEMS AND METHODS FOR HYBRID MARINE PROPULSION SYSTEMS

(75) Inventor: Charles H. Eichinger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 327 days.

(21) Appl. No.: 12/701,854

(22) Filed: Feb. 8, 2010

(65) Prior Publication Data

US 2011/0195623 A1 Aug. 11, 2011

(51) Int. Cl.
*F01P 3/20* (2006.01)

(52) U.S. Cl. ..... 440/88 C; 440/3; 440/6

(58) Field of Classification Search .... 123/41.01–41.83; 440/3, 88 C, 88 G, 88 J, 88 D, 6
See application file for complete search history.

(56) References Cited

U.S. PATENT DOCUMENTS

| | | | | |
|---|---|---|---|---|
| 3,137,281 | A | 6/1964 | Fulker | |
| 4,371,351 | A | 2/1983 | Tousey | |
| 4,991,546 | A * | 2/1991 | Yoshimura | 123/41.31 |
| 5,045,001 | A | 9/1991 | Borst | |
| 6,406,344 | B1 | 6/2002 | Bland et al. | |
| 6,672,919 | B1 | 1/2004 | Beson | |
| 6,800,004 | B1 | 10/2004 | White et al. | |
| 7,001,231 | B1 | 2/2006 | Halley et al. | |
| 7,147,523 | B2 * | 12/2006 | Mori et al. | 440/3 |
| 7,318,396 | B1 * | 1/2008 | Belter et al. | 123/41.8 |
| 7,398,745 | B1 * | 7/2008 | White et al. | 123/41.01 |

* cited by examiner

*Primary Examiner* — Edwin Swinehart
(74) *Attorney, Agent, or Firm* — Andrus, Sceales, Starke & Sawall, LLP

(57) ABSTRACT

Cooling systems and methods for hybrid marine propulsion systems are disclosed. A first cooling circuit is arranged to convey raw cooling water through an internal combustion engine and to at least one drive component of a drive unit for the marine propulsion system. A second control circuit is arranged to convey raw cooling water through an electric motor. The system is arranged such that raw cooling water in the second cooling circuit is conveyed to the first cooling circuit to cool the drive component without cooling the component of the internal combustion engine.

18 Claims, 3 Drawing Sheets

COOLING SYSTEMS AND METHODS FOR HYBRID MARINE PROPULSION SYSTEMS

FIELD

The present disclosure relates to cooling systems and methods for hybrid marine propulsion systems. More particularly, the present disclosure relates to cooling systems and methods for parallel hybrid marine propulsion systems employing one or more electric motors and one or more internal combustion engines that are configured to separately and simultaneously power one or more marine propulsion units.

BACKGROUND

Cooling systems and methods for cooling internal combustion engines in marine propulsion systems are known in the art, examples of which are disclosed in U.S. Pat. Nos. 6,800,004 and 7,001,231.

SUMMARY

During development of hybrid marine propulsion systems utilizing one or more electric motors and one or more internal combustion engines to power one or more marine propulsion units, the present inventor invented the cooling systems and methods disclosed herein.

In one example, a hybrid marine propulsion system includes an internal combustion engine, an electric motor, a drive unit, a first cooling circuit, a second cooling circuit, and a controller. The first cooling circuit is arranged to convey raw cooling water to cool components of the internal combustion engine and to cool drive components of the drive unit. The second cooling circuit is arranged to cool a component of the electric motor. The first and second cooling circuits are further arranged such that raw cooling water in the second cooling circuit is conveyed to the first cooling circuit to cool the drive components of the drive unit. A valve is positionable between an open position to allow supply of raw cooling water through the internal combustion engine and drive unit via the first cooling circuit and a second position to prevent supply of raw cooling water from the second cooling circuit to a component of the internal combustion engine.

In a specific example, the component of the internal combustion engine includes an exhaust component such as an exhaust conduit or elbow. Positioning the valve in the second position prevents raw cooling water from the second cooling circuit from escaping the cooling system via the exhaust elbow, thus facilitating efficient and effective supply of raw cooling water to the downstream drive unit.

BRIEF DESCRIPTION OF THE DRAWINGS

The present disclosure includes the following drawing figures.

DETAILED DESCRIPTION OF THE DRAWINGS

In the present disclosure, certain terms have been used for brevity, clearness and understanding. No unnecessary limitations are to be implied therefrom beyond the requirement of the prior art because such terms are used for descriptive purposes only and are intended to be broadly construed. The different methods, structures and systems described herein may be used alone or in combination with other methods, structures and systems. Various equivalents, alternatives and modifications are possible within the scope of the appended claims. In the appended claims, the inventor intends to invoke interpretation under 35 U.S.C. §112, sixth paragraph in a particular claim only where the words "means" and "for" are used in that claim. Otherwise, interpretation of the claims under Section 112, sixth paragraph is not intended.

Figure 1:
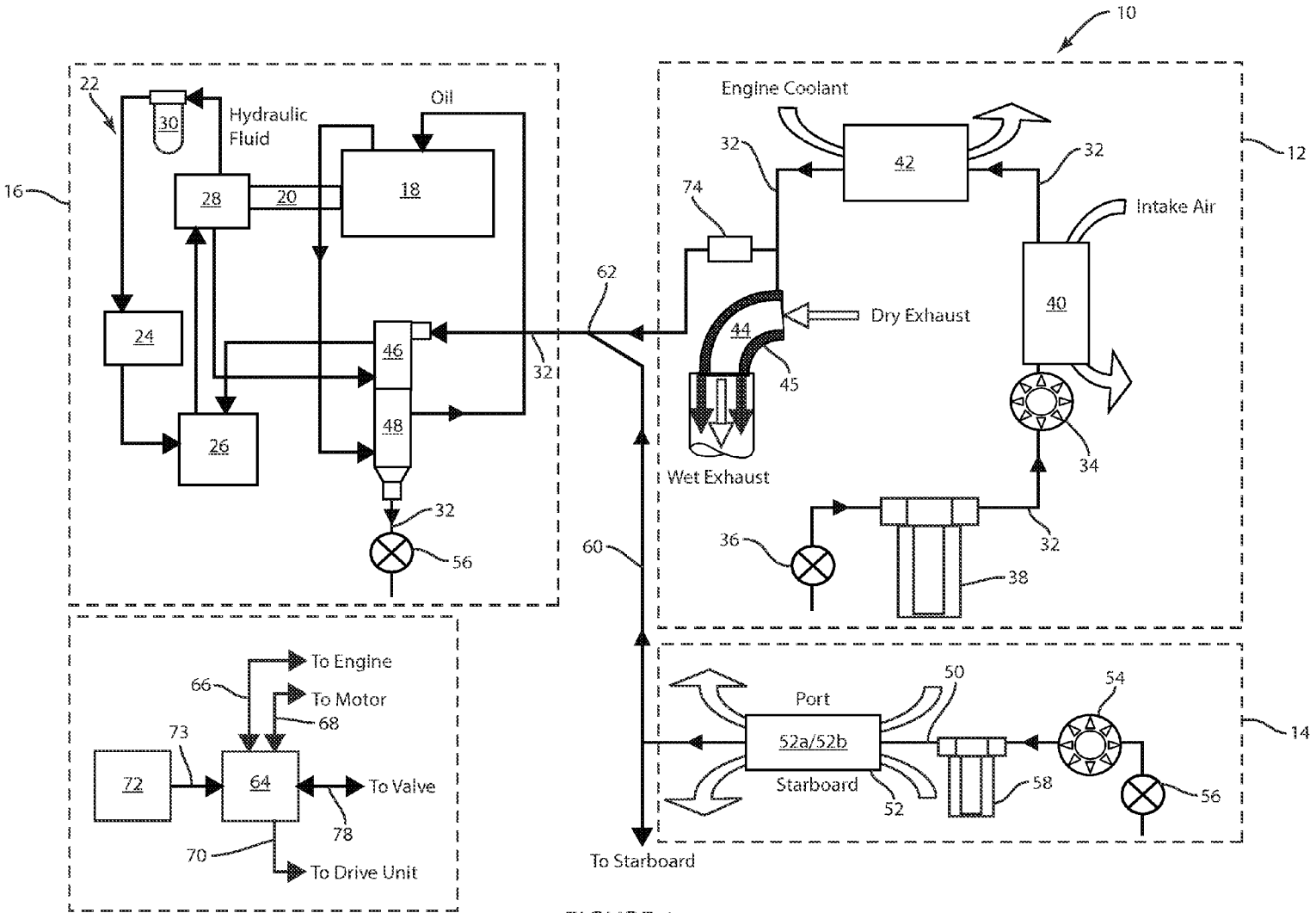
FIG. 1 is a first example of a hybrid marine propulsion system including an internal combustion engine, an electric motor, a drive unit, a cooling system, and a programmable controller.

FIG. 1 depicts a hybrid marine propulsion system 10 for propelling a marine vessel. The system 10 includes an internal combustion engine 12 and an electric motor 14, which operate simultaneously to provide power to a drive unit 16 for driving a propeller or other means for causing movement of the marine vessel. Although FIG. 1 depicts only one internal combustion engine 12 and one electric motor 14, the presently described systems and methods can be employed with systems including more than one internal combustion engine and/or electric motor. Although one drive unit 16 is depicted in FIG. 1, the system can also include a second drive unit in a standard port/starboard drive unit arrangement, or can also alternately include multiple drive units.

The internal combustion engine 12 includes typical components that are necessary to facilitate engine operation including intake, valve, cylinder and exhaust components. These components are not depicted in FIG. 1, but the scope and content of these components are known to one skilled in the art. It should be recognized that the systems and methods claimed herein are applicable to any type of internal combustion engine for use in hybrid systems for powering marine vessels.

The electric motor 14 includes the typical components that are necessary to convert electrical energy into mechanical energy via for example interaction of magnetic fields and current carrying conductors. These components are not depicted in FIG. 1, but the scope and content of these components are known to one skilled in the art. It should be recognized that the systems and methods claimed in the present disclosure are applicable to any variety of electric motor for use in hybrid systems for powering a marine vessel.

The drive unit 16 includes the components facilitating transfer of power from the internal combustion engine 12 and the electric motor 14 to a propulsion unit (not shown) such as a pod drive or inboard propeller. These drive components can include for example transmission gears and/or steering gears. Again, these components are not depicted in FIG. 1, but the scope and content of these components are known to one skilled in the art. It should be recognized that the systems and methods claimed in the present disclosure are applicable to any variety of drive unit for use in hybrid systems for powering a marine vessel. In the example shown in FIG. 1, a transmission is shown schematically at 18, a drive shaft is shown schematically at 20, and a hydraulic circuit for a steering/transmission system is shown schematically at 22 and includes a trim or steering actuator 24, a hydraulic fluid reservoir 26, hydraulic fluid pump 28, and related filter 30. These components are not essential and different configurations for a drive unit could be employed.

The internal combustion engine 12, electric motor 14, and drive unit 16 operate at high temperatures and thus require continuous or intermittent cooling during operation to prevent thermal breakdown and to increase efficiency. In the example shown, a first cooling circuit 32 is arranged to cool components of the internal combustion engine 12 and components of the drive unit 16. Raw cooling water, for example water extracted from the body of water in which the marine vessel is situated, is conveyed through the first cooling circuit 32 to a series of coolers or heat exchangers that are configured to cool the respective components of the internal combustion engine 12 by promoting heat transfer between the relatively cool raw cooling water and the relatively hot component. The raw cooling water is then conveyed via the first cooling circuit 32 to a series of coolers or heat exchangers that are configured to cool the respective drive components of the drive unit 16 by promoting heat transfer between the relatively cool raw cooling water and the relatively hot component. Specifically, a pump 34, such as an impeller pump, creates a suction force that draws raw cooling water through a sea cock 36 situated in a location that is suitable for accepting raw cooling water from the body of water (for example a location on the hull of the marine vessel). The raw cooling water is drawn into the first cooling circuit 32 and strained in strainer 38 to remove particulate matter and other debris. Thereafter, the raw cooling water is pumped through the remainder of the first cooling circuit 32, including through an engine intake air cooler 40, an engine cooler 42, and an exhaust conduit or elbow 44 (with associated cooling jacket 45) in the internal combustion engine 12, and a steering cooler 46 and a transmission cooler 48 in the drive unit 16. Each of the coolers 40, 42, 45, 46, and 48 can include conventional heat exchanger-type coolers which are commonly used to promote heat exchange between the relatively cool raw cooling water and the relatively hot engine components and drive unit components. Thereafter, relatively warm raw cooling water is emitted downstream of the transmission cooler 48 via sea cock 56 for disposal into the body of water in which the marine vessel is located.

As stated, each of the coolers facilitates exchange heat between the relatively cool raw cooling water and a respective component of either the internal combustion engine 12 or the drive unit 16. For example, the engine intake air cooler 40 facilitates heat exchange from the engine intake air to the raw cooling water. The engine cooler 42 facilitates heat exchange from the relatively hot engine coolant, such as glycol, and the relatively cool raw cooling water. The exhaust elbow 44 facilitates heat exchange between the hot exhaust and the raw cooling water and also emits raw cooling water into the exhaust conduit or elbow to create wet exhaust according to known techniques. The steering cooler 46 facilitates heat exchange between hydraulic fluid in the steering/transmission system 22 and the raw cooling water. The transmission cooler 48 facilitates heat exchange between transmission fluid, such as oil, and the raw cooling water. These heat exchange activities serve to continuously cool the internal combustion engine 12 and drive unit 16 during operation by utilizing relatively cool raw cooling water in which the marine vessel is situated.

A second cooling circuit 50 is arranged to convey raw cooling water through the electric motor 14 and through at least one electric motor cooler 52. The example shown in FIG. 1 includes coolers 52*a* and 52*b* for both port and starboard electric motors 14 on the marine vessel. Specifically, a pump 54, such as an electric pump, draws raw cooling water from the body of water in which the marine vessel is situated through a sea cock 56 located, for example, on the hull of the marine vessel. The pump 54 draws the raw cooling water through a strainer 58 for removing particulate matter and debris from the raw cooling water. The pump 54 then pumps the strained raw cooling water to the electric motor coolers 52*a*, 52*b*, via the second cooling circuit 50. The electric motor coolers 52*a*, 52*b* are heat exchangers that facilitate an exchange of heat between the electric motor 14 and the relatively cool raw cooling water.

Raw cooling water is conveyed through the electric motor coolers 52*a*, 52*b* and also to the first cooling circuit 32 via a bypass circuit 60 connecting the second cooling circuit 50 to the first cooling circuit 32. Raw cooling water in the second cooling circuit 50 is thus supplied to the first cooling circuit 32 via the bypass circuit 60 to cool drive components in the drive unit 16, such as the transmission or steering components. This can be accomplished without supplying raw cooling water from the second cooling circuit 50 to components in the internal combustion engine 12, as will be discussed further below. The system 10 is thus configured so that raw cooling water pumped by the pump 54 through the second cooling circuit 50 is supplied to the drive unit 16 whenever the pump 54 is operating (which is normally whenever the electric motor 14 is operating). Also, raw cooling water pumped by the pump 34 through the first cooling circuit 32 is also supplied to the drive unit 16 whenever the pump 34 is operating (which is typically whenever the internal combustion engine 12 is operating). Raw cooling water from the first and second cooling circuits 32, 50 is combined at the location 62 where the bypass circuit 60 joins with the first cooling circuit 32. The location 62 can vary, as will be discussed further below with reference to FIGS. 2 and 3. However, preferably the location 62 is situated downstream of the series of coolers for cooling the components of the internal combustion engine and upstream of the series of coolers for cooling the components of the drive unit. In the example shown in FIG. 1, the bypass circuit 60 joins with the first cooling circuit 32 at location 62. From the location 62, when both the engine 12 and the electric motor 14 are operating, raw cooling water from the first cooling circuit 32 and raw cooling water from the second cooling circuit 50 mix together and are conveyed by the first cooling circuit 32 to cool components in the drive unit 16.

The system 10 also includes a controller 64 communicatively connected to the internal combustion engine 12, electric motor 14 and drive unit 16 via wired or wireless communication links, shown schematically at 66, 68, 70 respectively. The controller 64 contains a memory and processer containing programmable logic for controlling the operations of the internal combustion engine 12, the electric motor 14, and the drive unit 16. The controller 64 is shown schematically as a single box, however it should be understood that the controller can alternately include several control modules that are physically separate and located at different locations in the system 10 or at different locations in the marine vessel and communicate with each other via wired or wireless communication links to achieve the functions described herein. The controller 64 is equipped to receive and send signals via the noted communication links 66, 68, 70 to monitor the operational status of the internal combustion engine 12, electric motor 14, and drive unit 16 and to control the operations of the internal combustion engine 12, electric motor 14 and drive unit 16. Signals can be sent from and to sensor devices and actuation devices located at components in the system 10 to perform these functions, as will be understood by one skilled in the art. The controller 64 is also equipped to receive user inputs from a user input device 72 via a communication link 73. The user input device can include a steering wheel, throttle and transmission lever or levers, joystick, or any number of other such devices for inputting a command to the system 10. This type of control arrangement is well known.

The system 10 is operable in several different modes, examples of which are described herein. Each of these modes is designed to maintain efficiency and/or achieve operational parameters required by the user or for optimal performance of the marine vessel. The interrelationship of the operation of the internal combustion engine and the electric motor can be tailored to maintain fuel efficiency and/or achieve optimal performance characteristics in a hybrid arrangement. The following are just examples of such operational modes. The controller 64 is preferably programmed to control the various components of the system to switch between and achieve the following modes during system operation. The controller 64 thus is programmed to directly or indirectly control operation of pumps 34, 54 to selectively provide raw cooling water to the first and second cooling circuits 32, 50 depending on the particular mode of operation that is active.

In an Electric Only Mode, the electric motor 14 is typically operating and the pump 54 is operating to pump raw cooling water to the second cooling circuit 50 and then to the first cooling circuit 32 via the bypass circuit 60, as described above. In this mode, the internal combustion engine 12 is not operating and therefore the pump 34 is also not operating and raw cooling water is not supplied through the portion of the first cooling circuit 32 located in the internal combustion engine 12. In this mode, it is also possible to turn off the electric motor 14, in which case the pump 54 would also stop, thus ceasing the flow of raw cooling water through the second cooling circuit 50, as described above.

In an Engine Only Mode, the internal combustion engine 12 is typically operating and the pump 34 is operating to pump raw cooling water through the first cooling circuit 32 to cool components in the internal combustion engine 12 and the drive unit 16 as described above. In this mode, the electric motor 14 is not operating and therefore the electric pump 34 is also not operating and raw cooling water is not supplied through the second cooling circuit 50 or through the bypass circuit 60.

In a Hybrid Assist Mode, both the internal combustion engine 12 and the electric motor 14 are operating and thus both pumps 34 and 54 are operating to pump raw cooling water through the system 10, as described above.

In a Hybrid Generator Mode, both the internal combustion engine 12 and the electric motor 14 are operating. A generator (not shown) is also operating so that operation of the internal combustion engine 12 can be used to charge or recharge batteries (not shown) providing power to the electric motor 14.

In the example shown in FIG. 1, a valve 74 is provided in the first cooling circuit 32 and is positionable between an open position and a closed position. In the open position, supply of raw cooling water is allowed to freely pass through the valve 74 and on through the first cooling circuit 32. In the closed position, supply of raw cooling water is prevented from passing through the valve 74. In the closed position, the valve 74 prevents passage of raw cooling water in either the downstream direction or the upstream direction through the remainder of the first cooling circuit 32. Therefore, in the closed position, supply of raw cooling water from the second cooling circuit 50 is prevented from travelling upstream towards the internal combustion engine 12 and is prevented from escaping out the exhaust elbow 44.

In one example, the valve 74 includes an electric valve (such as a solenoid valve) that is automatically actuated to move from the open position to the closed position or vice versa based upon a predetermined operational characteristic of the system 10, such as whether or not the internal combustion engine 12 and/or pump 34 is operating. This type of arrangement would not necessarily require active control from the controller 64. In one example, the valve 74 is configured to automatically move from the open position to the closed position when the internal combustion engine 12 stops operating. Alternatively the valve 74 could be configured to automatically move from the open position to the closed position when the pump 34 or other component of the internal combustion engine 12 stops operating. Closing of the valve 74 advantageously prevents backflow of raw cooling water from the bypass circuit 60 upstream to the exhaust conduit or elbow 44 in the Electric Only Mode. This advantageously prevents waste of raw cooling water by discharge through the exhaust elbow 44. Instead, the raw cooling water from the bypass circuit 60 is forced by the pump 54 to flow to the drive unit 16 and through steering cooler 46 and transmission cooler 48, thereby maximizing the noted cooling functions of these devices. In this arrangement, if the valve 74 should fail to close because of a system defect or some other reason, the exhaust elbow 44 will still be protected from overheating as raw cooling water will flow upstream from the location 62 to the water jacket of the exhaust elbow 44. The downstream drive components may eventually overheat because of the loss of raw cooling water to the open exhaust elbow 44, but the overheating will occur at a rate that is much slower compared to the exhaust elbow 44 and thus such a situation is less time critical.

In another example, the position of the valve 74 can be controlled by controller 64. The controller 64 can be programmed to monitor the status of components in the system 10 or to monitor the status of which control mode the system 10 is operating, and then actuate the valve 74 to move between the open position and closed position according to a set of criteria, such as can be set forth in a look-up table. In this example, the controller 64 is configured to communicate with and send commands to a receiving component or actuator for the valve 74 via a wired or wireless link 78. The controller 64 can be programmed to follow different control instructions based upon user criteria. One example of such a look-up table is set forth in Table 1 below.

TABLE 1

| Mode | Engine Status | Motor Status | Generator Status | Pump 34 Status | Pump 54 Status | Valve 74 Status |
|---|---|---|---|---|---|---|
| Electric Only (Motor Running) | Off | On | Off | Off | On | Closed |
| Electric Only (Motor Not Running) | Off | Off | Off | Off | Off | Either Open or Closed |
| Hybrid Assist | On | On | Off | On | On | Open |
| Hybrid Generator | On | Off | On | On | On | Open |
| Hybrid Motor | On | Off | Off | On | On | Open |
| Engine Only | On | Off | Off | On | Off | Open |

Figure 2:
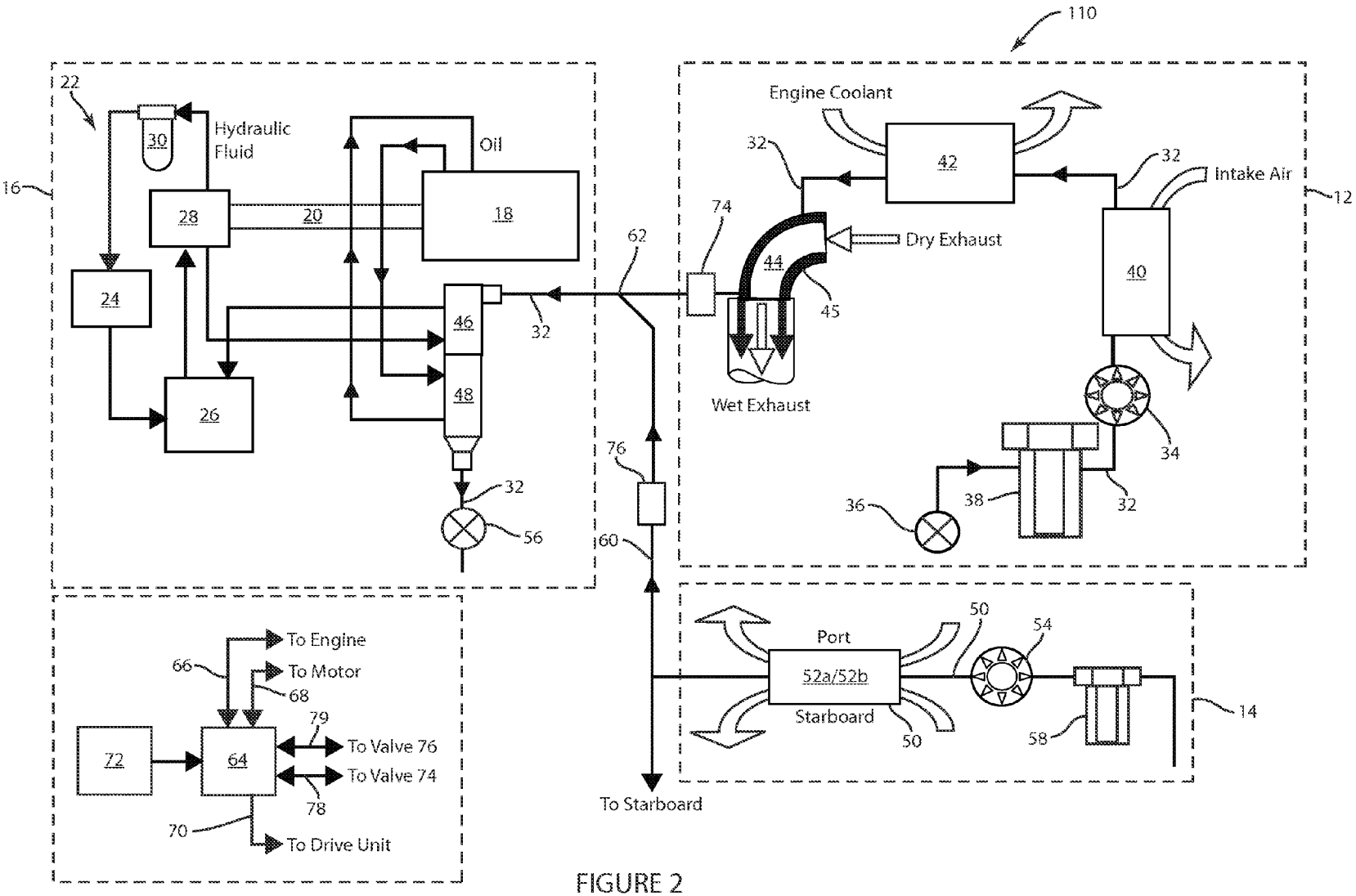
FIG. 2 is a second example of a hybrid marine propulsion system including an internal combustion engine, an electric motor, a drive unit, a cooling system, and a programmable controller.

FIG. 2 provides another example of a hybrid marine propulsion system 110. The system 110 includes many of the same components described above with respect to the system 10 shown in FIG. 1. Each of these components has like reference numerals to those described above with respect to FIG. 1.

The system 110 also includes an additional valve 76 arranged in the bypass circuit 60. Like the valve 74, the valve 76 is positionable between an open position and a closed position preventing flow of raw cooling water through the bypass circuit 60 when the pump 54 is not supplying raw cooling water through the second cooling circuit 50 and the bypass circuit 60. The valve 76 thus advantageously prevents backflow of raw cooling water to the pump 54 when the internal combustion engine 12 and related pump 34 is operational and the electric motor 14 and related pump 54 are not operational, such as for example in the Engine Only Mode. Like the valve 74, the valve 76 can operate with or without active control from controller 64. In FIG. 2, active control for valve 74 is provided by controller 64 via wired or wireless communication link 78. Active control for valve 76 is provided by controller 64 via wired or wireless communication link 79.

Figure 3:
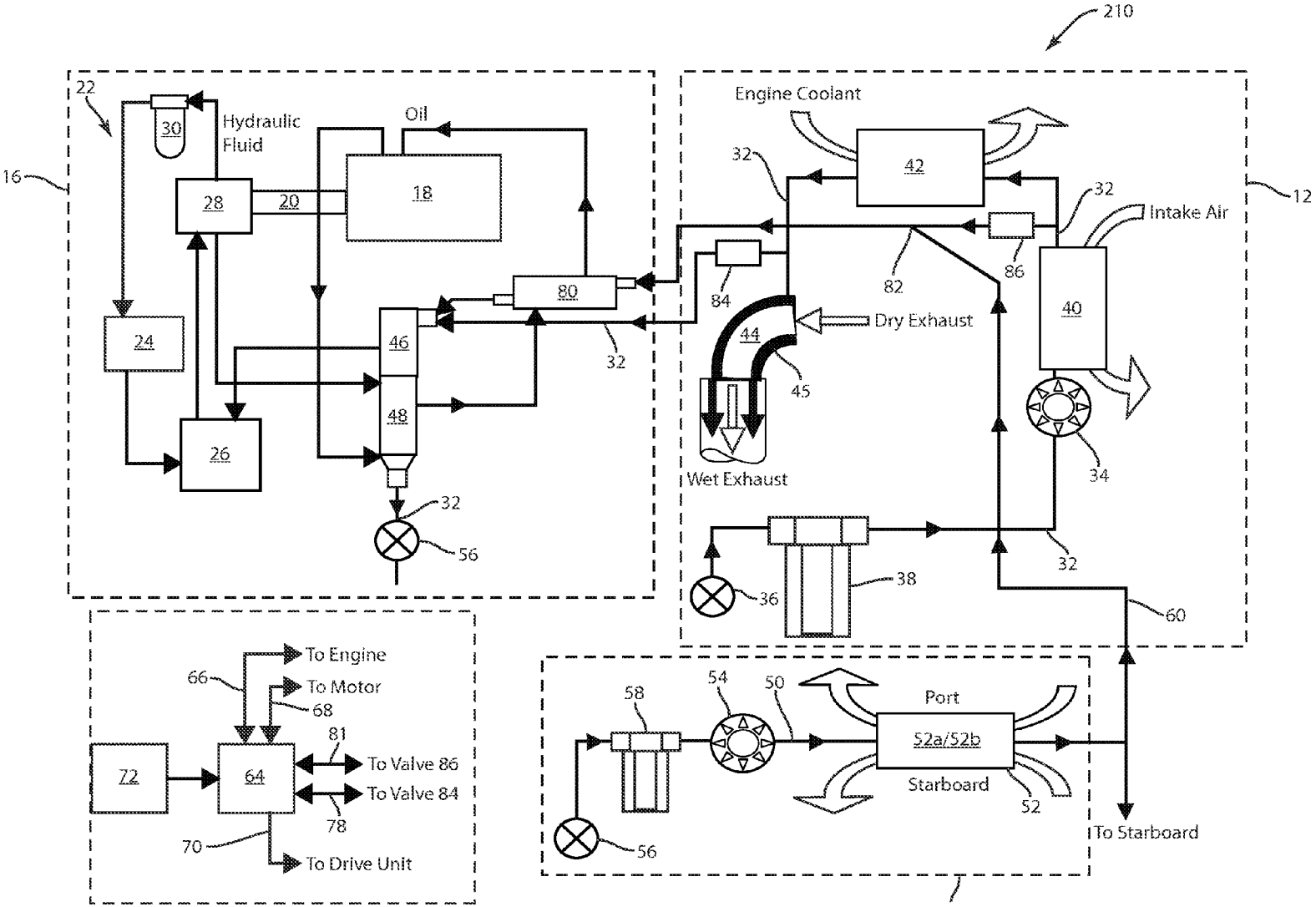
FIG. 3 is a third example of a hybrid marine propulsion system including an internal combustion engine, an electric motor, a drive unit, a cooling system, and a programmable controller.

FIG. 3 depicts a hybrid marine propulsion system 210 having many of the same components of the system 10 described above with reference to the system 10 shown in FIG. 1. Common reference numbers are utilized for common components between systems 10 and 210.

System 210 further includes an additional cold water cooler 80 for providing additional cooling to steering and transmission coolers 46, 48. The bypass circuit 60 intersects with the first cooling circuit 32 at location 82 upstream of the exhaust elbow 44. Two valves 84, 86 are provided in the first cooling circuit 32 at locations upstream and downstream of the exhaust elbow 44, respectively. This arrangement forces raw cooling water from the bypass circuit 60 to flow downstream and thus does not rely on the pump 54 to prevent backflow. As in the systems 10 and 110, the valves 84, 86 do not have to be actively controlled, but rather could be configured to actuate and move between open and closed positions depending upon an operational characteristic of the system 210. In the example of FIG. 3 however, the valves are actively controlled by the controller 64 in a manner similar to that described above with reference to FIGS. 1 and 2. Active control for valve 84 is provided by controller via wired or wireless communication link 78. Active control for valve 86 is provided by controller via wired or wireless communication link 81. In this example, when valves 84 and 86 are closed, backflow of raw cooling water through the first cooling circuit to the exhaust elbow 44 and to other components of the internal combustion engine 12 is prevented. When valves 84 and 86 are opened, supply of raw cooling water through the first cooling circuit is allowed.

What is claimed is:

1. A cooling system for cooling a hybrid marine propulsion system having an internal combustion engine, an electric motor, and a drive unit that transfers power from the internal combustion engine and the electric motor for propelling a marine vessel, the cooling system comprising:

a first pump that pumps raw cooling water through a first cooling circuit for cooling the internal combustion engine and the drive unit, the first cooling circuit extending from a first upstream inlet to a downstream outlet;

wherein the first cooling circuit conveys the raw cooling water that is pumped by the first pump through the internal combustion engine so as to cool a component of the internal combustion engine and then through the drive unit so as to cool a component of the drive unit;

a bypass cooling circuit connected to the first cooling circuit at a location along the first cooling circuit that is between the component of the internal combustion engine and the component of the drive unit; and a second pump that pumps raw cooling water through a second cooling circuit for cooling the electric motor, the second cooling circuit being separate from the first cooling circuit and extending from a second upstream inlet to the bypass cooling circuit;

wherein the second cooling circuit conveys the raw cooling water that is pumped by the second pump through the electric motor so as to cool a component of the electric motor and then to the bypass cooling circuit;

wherein cooling water that is pumped by the second pump is received by the first cooling circuit via the bypass cooling circuit and is conveyed by the first cooling circuit through the drive unit so as to cool the component of the drive unit.

2. A cooling system according to claim 1, wherein the first pump operates when the internal combustion engine operates and wherein the first pump ceases operating when the internal combustion engine ceases operating.

3. A cooling system according to claim 2, wherein the first pump is a hydraulic fluid pump.

4. A cooling system according to claim 2, wherein the second pump operates when the electric motor operates and wherein the first pump ceases operating when the electric motor ceases operating.

5. A cooling system according to claim 4, wherein the second pump is an electric pump.

6. A cooling system according to claim 4, comprising a controller that is programmed to control operation of the first pump such that the first pump operates when the internal combustion engine operates and such that the first pump ceases operating when the internal combustion engine ceases operating, and such that the second pump operates when the electric motor operates and such that the second pump ceases operating when the electric motor ceases operating.

7. A cooling system according to claim 1, comprising a first valve that is positionable in an open position to allow flow of raw cooling water from the first pump to the component of the drive unit, wherein the first valve is positionable in a closed position to prevent back flow of raw cooling water from the second pump to the component of the internal combustion engine via the first cooling circuit.

8. A cooling system according to claim 7, wherein the first valve moves from the open position to the closed position when a component of the internal combustion engine ceases operating.

9. A cooling system according to claim 7, wherein the first valve moves from the open position to the closed position when the first pump ceases operating.

10. A cooling system according to claim 7, wherein the component of the internal combustion engine comprises an exhaust conduit and wherein the first valve in the closed position prevents flow of raw cooling water from the second pump from entering the exhaust conduit.

11. A cooling system according to claim 10, wherein the exhaust conduit comprises an exhaust elbow into which cooling water from the first cooling circuit is discharged to thereby mix with and cool exhaust gas.

12. A cooling system according to claim 7, wherein the bypass cooling circuit is connected to the first cooling circuit at a location that is upstream of an exhaust elbow into which cooling water from the first circuit is discharged to thereby mix with and cool exhaust gas.

13. A cooling system according to claim 12, comprising a second valve located downstream of the exhaust elbow; wherein the first and second valves are located in the first cooling circuit.

14. A cooling system according to claim 7, comprising a controller that is programmed to control operation of the first valve such that the valve is moved into the closed position when the internal combustion engine stops operating.

15. A cooling system according to claim 14, wherein the controller is configured to cause the first valve to move into the open position when the internal combustion engine begins operating.

16. A cooling system according to claim 7, comprising a second valve; wherein the first valve is located in the first cooling circuit and wherein the second valve is located in one of the second cooling circuit and the bypass cooling circuit; wherein the second valve is positionable in an open position to allow upstream to downstream flow of raw cooling water from the first pump to the component of the drive unit; and wherein the second valve is positionable in a closed position to prevent back flow of raw cooling water from the first pump to the component of the electric motor.

17. A hybrid marine propulsion system comprising:

an internal combustion engine;

an electric motor;

a drive unit that transfers power from the internal combustion engine and the electric motor for propelling a marine vessel;

a first pump that pumps raw cooling water through a first cooling circuit for cooling the internal combustion engine and the drive unit, the first cooling circuit extending from a first upstream inlet to a downstream outlet;

wherein the first cooling circuit conveys the raw cooling water that is pumped by the first pump through the internal combustion engine so as to cool a component of the internal combustion engine and then through the drive unit so as to cool a component of the drive unit;

a bypass cooling circuit connected to the first cooling circuit at a location along the first cooling circuit that is between the component of the internal combustion engine and the component of the drive unit; and a second pump that pumps raw cooling water through a second cooling circuit for cooling the electric motor, the second cooling circuit being separate from the first cooling circuit and extending from a second upstream inlet to the bypass cooling circuit;

wherein the second cooling circuit conveys the raw cooling water that is pumped by the second pump through the electric motor so as to cool a component of the electric motor and then to the bypass cooling circuit;

wherein cooling water that is pumped by the second pump is received by the first cooling circuit via the bypass cooling circuit and is conveyed by the first cooling circuit through the drive unit so as to cool the component of the drive unit.

18. A method of cooling a hybrid marine propulsion system having an internal combustion engine, an electric motor, and a drive unit that transfers power from the internal combustion engine and the electric motor, the method comprising:

operating a first pump to pump raw cooling water through the internal combustion engine and then through the drive unit such that the raw cooling water flows from upstream to downstream and so that heat is transferred between the raw cooling water and a component of the internal combustion engine to thereby cool the component of the internal combustion engine, and such that that heat is transferred between the raw cooling water and the component of the drive unit to thereby cool the component of the internal combustion engine; and operating a second pump to pump a raw cooling water through the electric motor and then through the drive unit, the raw cooling water flowing from upstream to downstream so that heat is transferred between the raw cooling water and a component of the electric motor to thereby cool the component of the electric motor, and so that heat is transferred between the raw cooling water and the component of the drive unit to thereby cool the component of the drive unit;

wherein cooling water that is pumped through the electric motor does not transfer heat with the component of the internal combustion engine.

* * * * *